US008950500B2

(12) United States Patent
Lieske, II

(10) Patent No.: US 8,950,500 B2
(45) Date of Patent: Feb. 10, 2015

(54) SUCTION PILE WELLHEAD AND CAP CLOSURE SYSTEM

(75) Inventor: Don D. Lieske, II, Missouri City, TX (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 587 days.

(21) Appl. No.: 13/170,436

(22) Filed: Jun. 28, 2011

(65) Prior Publication Data

US 2012/0024535 A1 Feb. 2, 2012

Related U.S. Application Data

(60) Provisional application No. 61/359,982, filed on Jun. 30, 2010.

(51) Int. Cl.
*E21B 7/12* (2006.01)
*E21B 43/01* (2006.01)

(52) U.S. Cl.
CPC ..... *E21B 43/0122* (2013.01)
USPC ..... 166/358; 166/363; 166/364; 166/71

(58) Field of Classification Search
USPC ..... 166/358, 363, 364, 71, 75.13; 175/5–7, 175/10; 405/227, 228, 232, 249
See application file for complete search history.

(56) References Cited

U.S. PATENT DOCUMENTS

| | | | | |
|---|---|---|---|---|
| 3,817,040 | A | 6/1974 | Stevens | |
| 4,318,442 | A * | 3/1982 | Lunde et al. | 166/357 |
| 4,324,505 | A * | 4/1982 | Hammett | 405/60 |
| 4,432,671 | A | 2/1984 | Westra et al. | |
| 4,510,985 | A | 4/1985 | Armin et al. | |
| 4,558,744 | A | 12/1985 | Gibb | |
| 4,575,282 | A | 3/1986 | Pardue et al. | |
| 4,706,757 | A * | 11/1987 | Harrington | 166/349 |
| 5,050,680 | A * | 9/1991 | Diehl et al. | 166/356 |
| 5,244,312 | A * | 9/1993 | Wybro et al. | 405/204 |
| 5,526,882 | A * | 6/1996 | Parks et al. | 166/339 |
| 6,692,194 | B2 | 2/2004 | Strand | |
| 7,621,059 | B2 | 11/2009 | McCoy, Jr. et al. | |
| 2011/0011320 | A1 | 1/2011 | Yemington | |
| 2012/0073823 | A1 * | 3/2012 | McClanahan et al. | 166/344 |
| 2012/0087729 | A1 * | 4/2012 | Oesterberg et al. | 405/60 |
| 2012/0285362 | A1 * | 11/2012 | Evans | 114/296 |

* cited by examiner

*Primary Examiner* — Matthew Buck
*Assistant Examiner* — Aaron Lembo
(74) *Attorney, Agent, or Firm* — Fish & Tsang, LLP

(57) ABSTRACT

Various embodiments of underwater wellhead closure systems are described that include a template having first and second anchoring ports and that is configured to be secured to a floor of a body of water. A suction pile having a cylindrical body with a head portion and an open bottom can be coupled to the first anchoring port, such that the suction pile can provide additional hold down force to the template. The system can also include a suction cap coupled to the second anchoring port, and having a cylindrical body with an open bottom and a head portion having at least one suction pump.

14 Claims, 6 Drawing Sheets

SUCTION PILE WELLHEAD AND CAP CLOSURE SYSTEM

This application claims the benefit of priority to U.S. provisional application having Ser. No. 61/359,982 filed on Jun. 30, 2010. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The present invention relates to underwater wellhead closure systems capable of encapsulating a wellhead and a blow-out preventer stack.

BACKGROUND

It has long been recognized to use suction piles in mooring systems for various structures, such as walkways, boat piers, floating drilling and production platforms, and various types of ships and buoy mooring systems. Typically, such systems utilize a tubular pile in which the open end of the pile is embedded into the seabed by hydrostatic pressure, such as described in U.S. Pat. No. 3,817,040 to Stevens, U.S. Pat. No. 4,432,671 to Westra, U.S. Pat. No. 4,575,282 to Pardue, and U.S. patent publ. no. 2011/0011320 to Yemington (publ. January 2011).

It is also known to utilize such suction piles in conjunction with offshore well drilling applications including, for example, drilling guides and other related applications, such as described in U.S. Pat. No. 4,510,985 to Arnim, U.S. Pat. No. 4,558,744 to Gibb, U.S. Pat. No. 6,692,194 to Strand, and U.S. Pat. No. 7,621,059 to McCoy.

As marine hydrocarbon well drilling has extended to increasingly deeper waters, including depths between 5,000-8,000 feet and deeper, deepwater well drilling has pushed the limits of conventional flow control and emergency shut-off procedures. For example, a primary method for stopping or preventing an uncontrollable flow in deep water wells is the use of a mud column having an equalizing pressure that resists unwanted hydrocarbon flow. If this method fails, a pre-installed blow-out preventer (BOP) is used such as that shown in FIG. 1, which is located at the sea floor/mud-line and connected to the wellhead. If the BOP should fail, such as what occurred at the Macondo prospect well in the Gulf of Mexico, various other solutions could be employed including, for example, drilling one or more relief wells, but such solution can be time-consuming to implement and thereby increases the extent of the oil spill.

Thus, there is still a need for systems configured to contain an uncontrollable deep water wellhead flow that can be implemented if the BOP fails.

SUMMARY OF THE INVENTION

The inventive subject matter provides apparatus, systems and methods for containing uncontrollable deep water wellhead flows, which allow for the direct kill of these flows at the sea floor/mud-line by utilizing pre-approved, pre-designed suction pile designs specific to the location of the failed wellhead.

Contemplated underwater wellhead closure systems include a template having first and second anchoring ports, which is configured to be secured to a floor of the ocean or other body of water. As used herein, the term "template" means a weighted, metal structure capable of being installed as a pre-assembly component or after a failed wellhead event.

The systems can also include at least one suction pile that is coupled to the first anchoring port, which can be configured to provide additional hold down force to the template to thereby secure the template to the ocean floor or other location. As used herein, the term "suction pile" means a conventional mooring pile for site-specific applications, and the term "sufficient hold down force" means a force that is sufficient to overcome the force resulting from the wellhead fluid flow. Contemplated suction piles can have an approximately cylindrical horizontal cross-section that includes a head portion and an open bottom, although any commercially suitable shapes could be used. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

A suction cap can be coupled to the second anchoring port of the template, and have an approximately cylindrical horizontal cross-section with an open bottom and a head portion that includes at least one suction pump. As used herein, the term "suction cap" means a unique capping pile that has a diameter large enough such that the suction cap can be disposed about a pre-installed BOP stack. It is contemplated that the suction cap can be configured to include necessary driving and pumping components including, for example, on-command hydrocarbon flow shut-in and suction pile installation. In some embodiments, the suction cap can completely contain or release upward hydrocarbon flow and pressure without the need for a suction pile.

Preferred suction caps and suction piles can include pipes, valves, fittings and pump configurations such that the suction caps and piles having built-in redundancy for each site specific application. In further contemplated embodiments, the suction caps or piles can include dual suction pumps, or dual pipe headers, as needed.

Various objects, features, aspects and advantages of the inventive subject matter will become more apparent from the following detailed description of preferred embodiments, along with the accompanying drawing figures in which like numerals represent like components.

DETAILED DESCRIPTION

One should appreciate that the disclosed techniques provide many advantageous technical effects including containment systems for stopping uncontrollable deep water wellhead flows by utilizing pre-approved, pre-designed suction pile designs specific to the location of the failed wellhead. Such systems can provide for a timely, economical solution to an uncontrollable flow and when fully implemented could provide a shut-in within approximately 72 hours. In addition, such systems can be pre-configured and manufactured by utilizing soil data already available from the well head and suction pile mooring system data bottom surveys.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
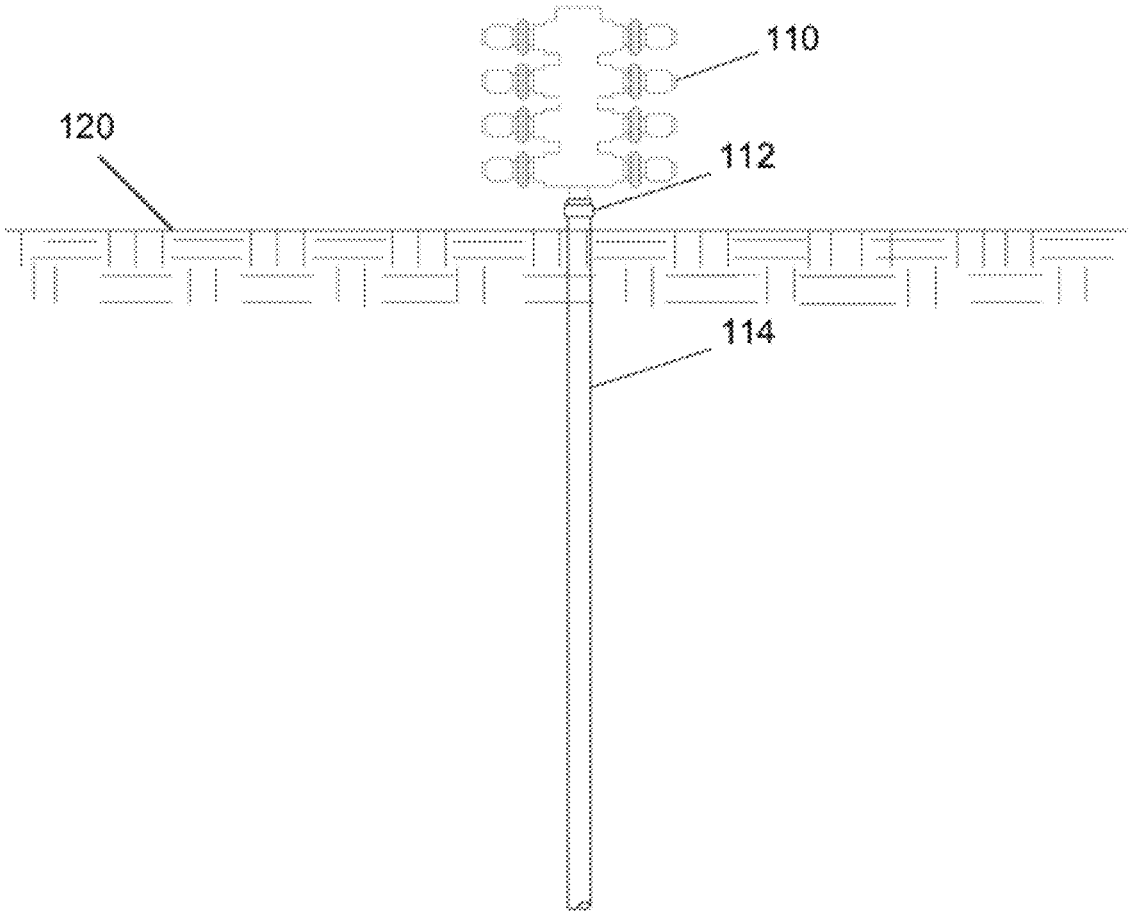
FIG. 1 is schematic of a prior art blow-out preventer stack.

FIG. 1 generally depicts a blow-out preventer stack 110 coupled to a wellhead 112 of a drill pipe 114, which extends through the seafloor/mud-line 120.

Figure 2:
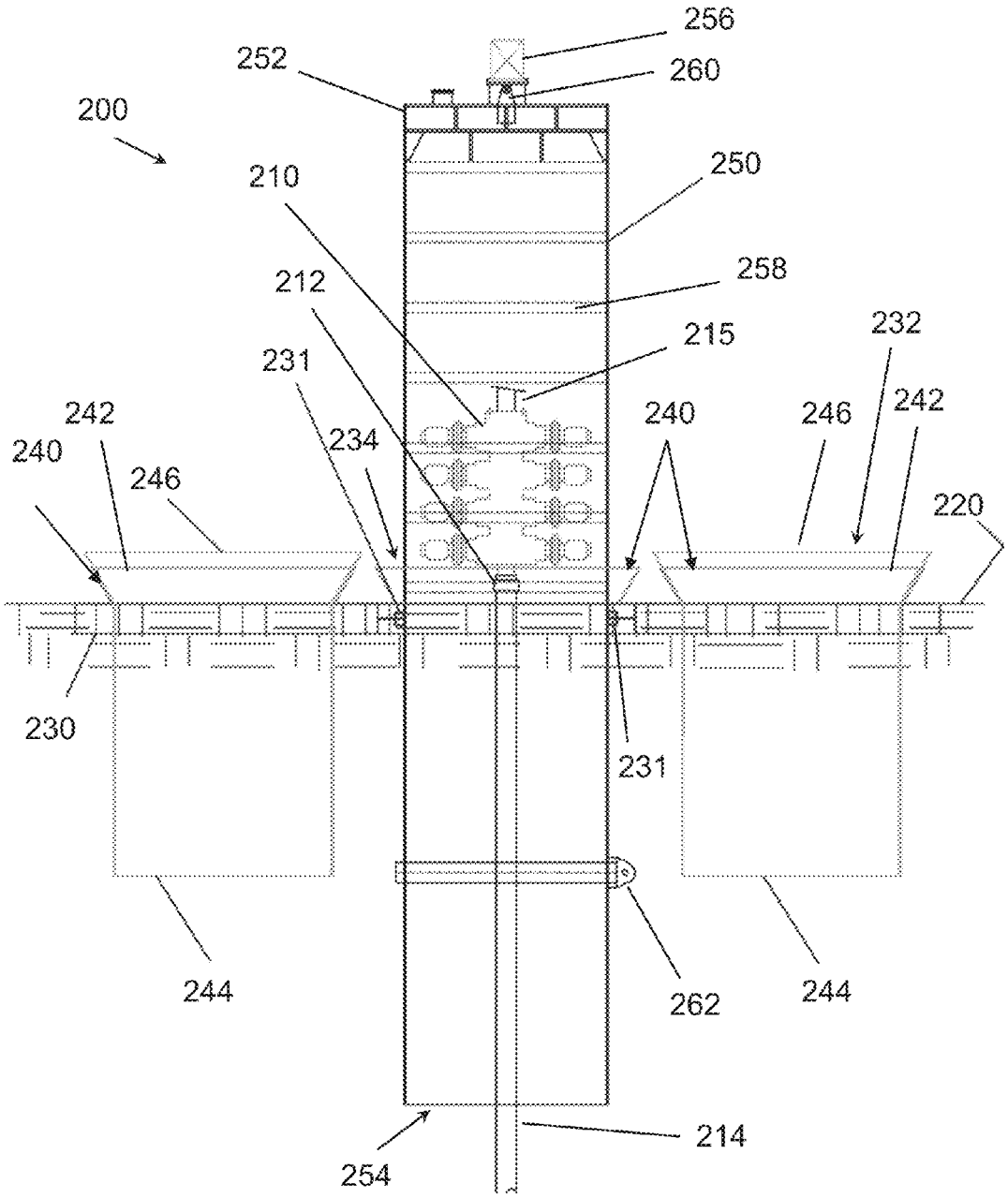
FIG. 2 is a schematic of one embodiment of an underwater wellhead closure system.

In FIG. 2, an embodiment of an underwater wellhead closure system 200 is shown having a template 230 configured to be secured to the ocean floor 220 or bottom of another body of water. The template 230 can include first and second anchoring ports 232 and 234, respectively. It is contemplated that at least one of the anchoring ports 232 and 234 could include one or more hydraulic locking devices 231 or any other commercially suitable locking devices.

Figure 3A:
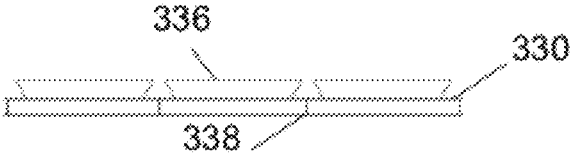
FIG. 3A-3B are side and top views, respectively, of one embodiment of a template.
Figure 3B:
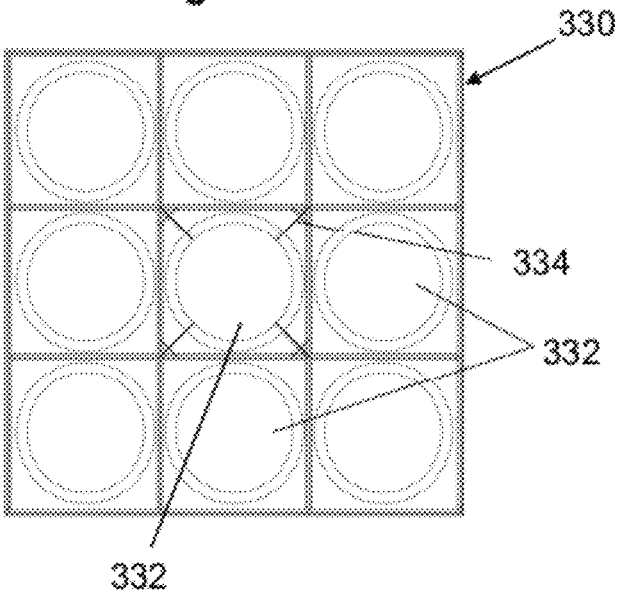

The template 230 can provide alignment locations for one or more suction piles 240 and a suction cap 250 on the ocean floor 220, and can advantageously act as the tie-in for the downward weight and upward pressure within suction cap 250, which allows a kill weight to be calculated for the complete system 200. It is contemplated that the template 230 can include third and fourth anchoring ports, or more, such as shown in FIGS. 3A-3B. The template 230 can further include one or more cones or other guides 247 that facilitate installation of the suction cap/piles.

Preferred templates 230 can be configured as a pre-assembly component for use in new well constructions or as a post-assembly component for use with existing wellheads.

A suction cap 250 acting as a pressure vessel is preferably coupled to the second anchoring port 234 of template 230. The suction cap 250 can have a preferably cylindrical horizontal cross-section, although any commercially suitable shape could be used. The suction cap 250 can include an open bottom 254 and a head portion 252 having at least one suction pump 256, which can be used to reduce the pressure within the suction cap 250 and thereby force the suction cap 250 into the ocean floor 220. Additional suction pumps could be included as necessary to overcome the volume of fluid exiting the wellhead pipe 215. It is contemplated that the head portion 252 can be stiffened as necessary to withstand expected pressures within the suction cap 250 including relevant safety factors. In some embodiments, the head portion 252 can be formed integral with the body of the suction cap 250, although it is alternatively contemplated that the head portion 252 and body can comprise separate components.

Preferably, the suction cap 250 is sized and dimensioned to allow the suction cap 250 to encapsulate a blow-out preventer stack 210 coupled to a wellhead 212 of a drill pipe 214. In this manner, the suction cap 250 can advantageously be disposed about the BOP 210 and coupled to the template 230 to thereby secure the suction cap 250 to the ocean floor 220 and contain the flow from the wellhead pipe 215. In addition, the suction cap 250 is preferably configured based upon the site-specific application, and can be configured prior to drilling at a site by utilizing known data from the wellhead and mooring surveys. In this manner, the suction cap 250 and system 200 can be rapidly deployed if the flow from an underwater well becomes uncontrollable.

The suction cap 250 can also include one or more internal stiffeners 258 to increase its overall strength and reduce the possibility that the suction cap 250 will buckle from the pressure forces acting on the suction cap 250. The suction cap 250 can also include one or more lifting lugs 260 to facilitate deployment of the suction cap 250. Optionally, the suction cap 250 can have a tailing lug 262 to increase seal closure, as necessary.

In some contemplated embodiments, especially in applications where the suction cap 250 fails to provide sufficient kill pressure for the wellhead, system 200 can include suction piles 240, at least one of which is coupled to the first anchoring port 232. Preferred suction piles 240 have a cylindrical horizontal cross-section, although any commercially suitable shape could be used. The suction piles 240 can include a head portion 242 and an open bottom 244, and the head portion 242 can include a suction pump (not shown). Although not shown, it is also contemplated that the suction piles 240 could include internal stiffeners (not shown) to strengthen the suction piles.

Although two suction piles 240 are shown, system 200 preferably includes between two to eight suction piles, although additional suction piles could be included as necessary such that the system 200 has sufficient hold down force. The specific number of suction piles 240 to be used will depend upon the downward weight of system 200 and upward pressure within suction cap 250. In some embodiments, a ballast ring 246 can be coupled to one or more of the suction piles 240 to add additional weight to system 200. The ballast rings 246 can either be installed prior to installation of the system 200, or placed in-situ on the ocean floor 220

It is contemplated that the suction piles 240 and suction cap 250 could be pre-configured such that they could be used for a semi-submersible mooring system for a drilling rig while also configured to be used as part of system 200 with little modification, which advantageously reduces the cost of system 200 and ensures that an uncontrolled wellhead flow can be quickly stopped. It is further contemplated that template 230, suction pile(s) 240, suction cap 250, and ballast rings 246 can be constructed of any commercially suitable material(s) including, for example, stainless steel and other metals and metal alloys, and any combinations thereof, such that the system 200 has sufficient weight to meet industry safety standards. In this manner, system 200 can provide a sufficient kill weight/pressure by utilizing the weight of the suction cap 250, suction pile(s) 240, ballast rings 246, and other hold-down components in consideration of the suction and hydrostatic pressure and other components of force. In some contemplated embodiments, the suction cap 250 and suction piles 240 can have substantially the same configurations, although it is alternatively contemplated that the suction cap 250 and suction piles 240 have different configurations. For example, it is contemplated that the suction cap 250 has dimensions that are greater than the dimensions of the suction piles 240.

FIGS. 3A and 3B illustrate a side view and a top view, respectively, of one embodiment of a template 330 having frame 338, which includes nine anchoring ports 332 that can collectively accommodate from one to eight suction piles (not shown) and a suction cap (not shown). The template 330 can also include locking devices 334 to secure the suction pile(s) and/or suction cap. Each anchoring port 332 can include a stabbing cone 336 with an approximate one feet annulus that acts as a guide to facilitate installation of suction piles and/or suction caps, although the stabbing cone 336 could have any commercially suitable size and dimension. Preferred stabbing cones 336 have a frustoconical vertical cross-section, although any commercially suitable shape could be used. It is further contemplated that the template 330 can include 2, 3, 4, 5, 6, 7, 8, 9 . . . 100, or more anchoring ports as dictated by the specific application.

Template 330 can be pre-fabricated for site-specific applications, and it is contemplated that additional anchoring ports can be added to or removed from template 330 as necessary. For example, if additional weight is needed to overcome the force of the fluid exiting the wellhead, additional anchoring ports and suction piles can be coupled to the template 330. In this manner, the template 330 can be readily customized for each site-specific application and be quickly deployed should a wellhead fail.

Figure 4A:
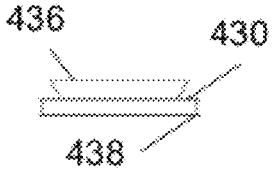
FIG. 4A-4B are side and top views, respectively, of another embodiment of a template.
Figure 4B:
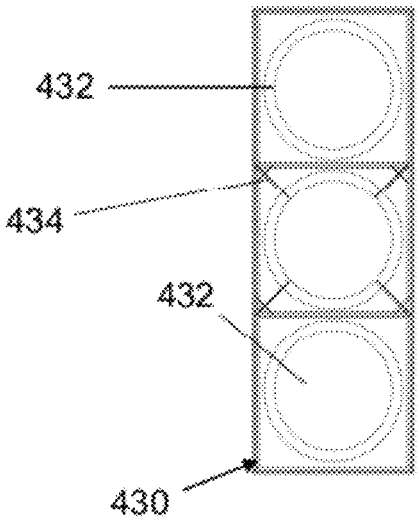

FIGS. 4A-4B illustrate side and top views, respectively, of another embodiment of a template 430 having three anchoring ports 432. The second and third anchoring ports 432 can be coupled to the central anchoring port to provide additional holding force to the template 430. With respect to the remaining numerals in each of FIGS. 4A-4B, the same considerations for like components with like numerals of FIGS. 3A-3B apply, respectively.

Figure 5:
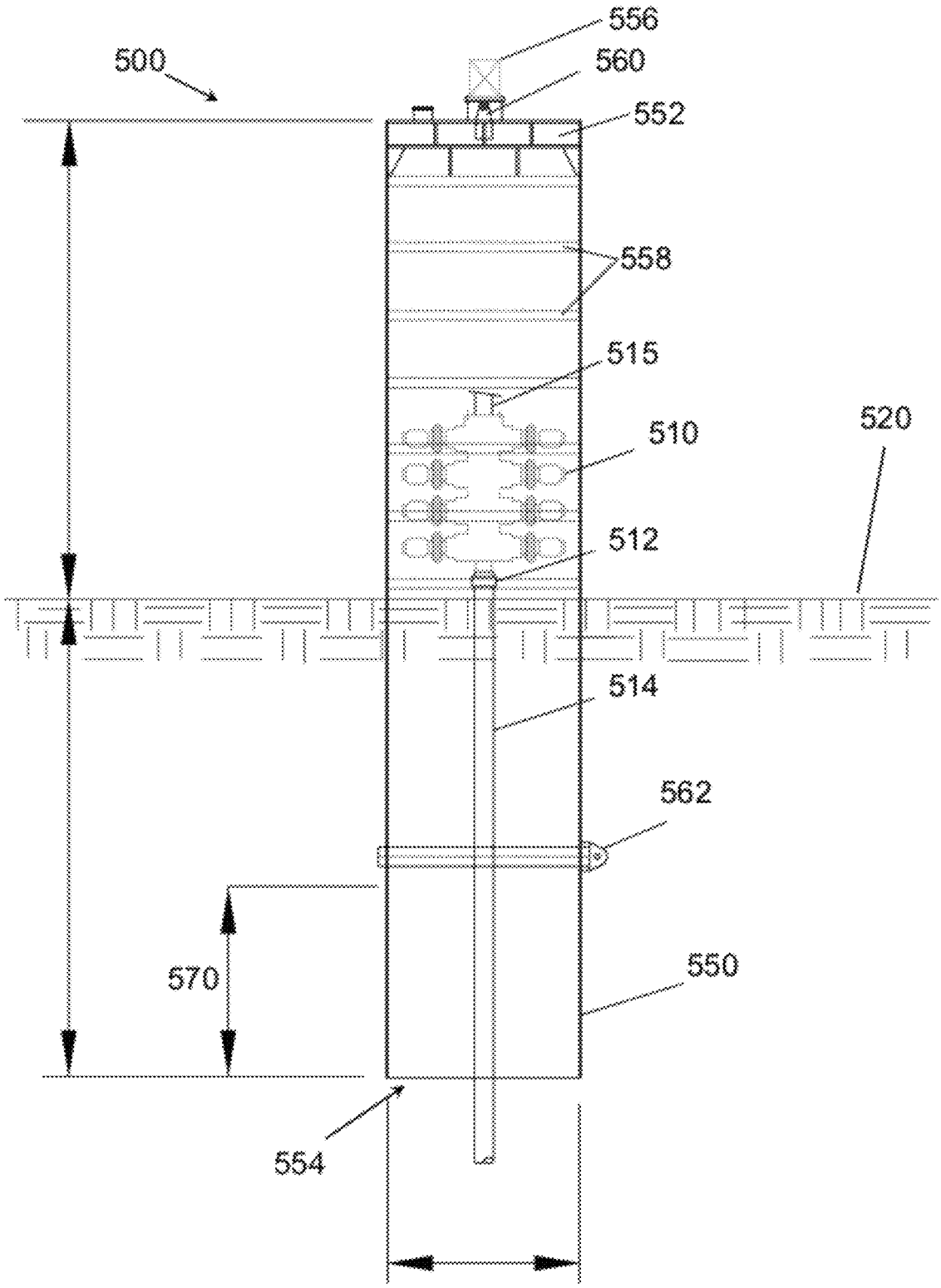
FIG. 5 is a schematic of another embodiment of an underwater wellhead closure system.

Although FIGS. 3A-3B and 4A-4B depict a 9 port system and a 3 port system, respectively, other configurations are also contemplated, including a single port design shown in FIG. 5.

In FIG. 5, another embodiment of an underwater wellhead closure system 500 is shown having a single port configuration that can be used in conjunction with a single wellhead where the flow pressure is low and the use of suction piles is not necessary. Depending on the size and dimension of each of the wellhead 512 and BOP 510, the suction cap 550 can be configured to include an extender 570 having a length of 10, 20, 30, 40, or 50 feet or greater to allow for additional penetration of the ocean floor 520. With respect to the remaining numerals in FIG. 5, the same considerations for like components with like numerals of FIG. 2 apply.

Figure 6:
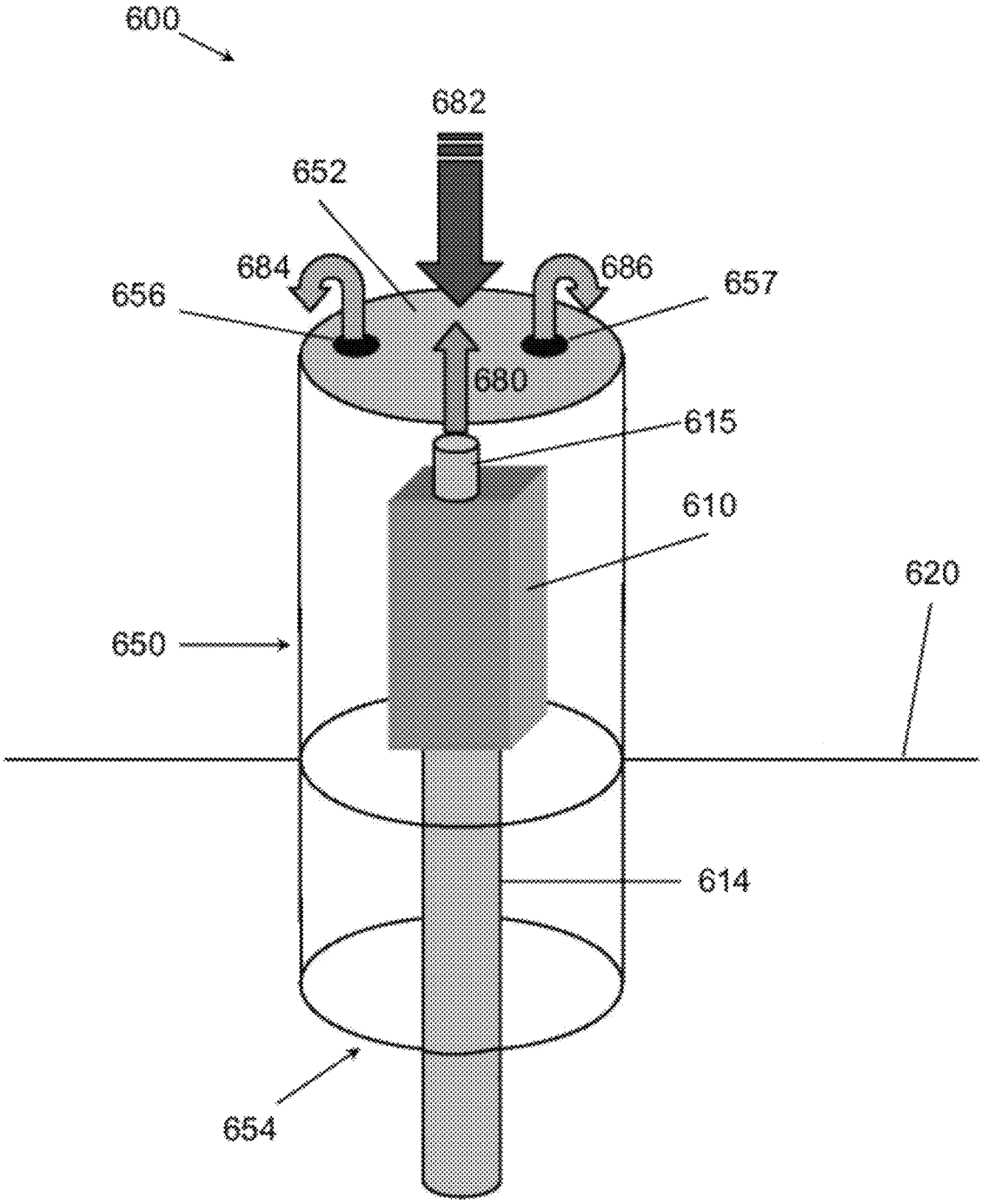
FIG. 6 is a schematic of an embodiment of a suction cap.

FIG. 6 illustrates one embodiment of a suction cap 650 having dual suction pumps 656 and 657, which are each configured to compensate for the fluid flow from the wellhead pipe 615. It is contemplated that the suction cap 650 can be configured to include multiple ports (not shown) for any commercially suitable applications, including, for example, electrical ports, liquid evacuation ports, and pressure relief ports. As shown in FIG. 6, the suction cap 650 can be configured such that it provides a kill weight/pressure sufficient to overcome the wellhead volume 680 by utilizing the weight of the suction cap 650, as well as suction pile(s), ballast ring(s), and any other hold-down components (not shown) in conjunction with the hydrostatic pressure 682 and frictional resistance of the soil with respect to the suction cap 650. In order to lower the suction cap 650 into the ocean floor 620, the volume that is collectively removed via suction pumps 684 and 686 must be greater than the wellhead volume 680, as this reduces the pressure within the suction cap 650 to be less than the hydrostatic pressure 682.

Figure 7:
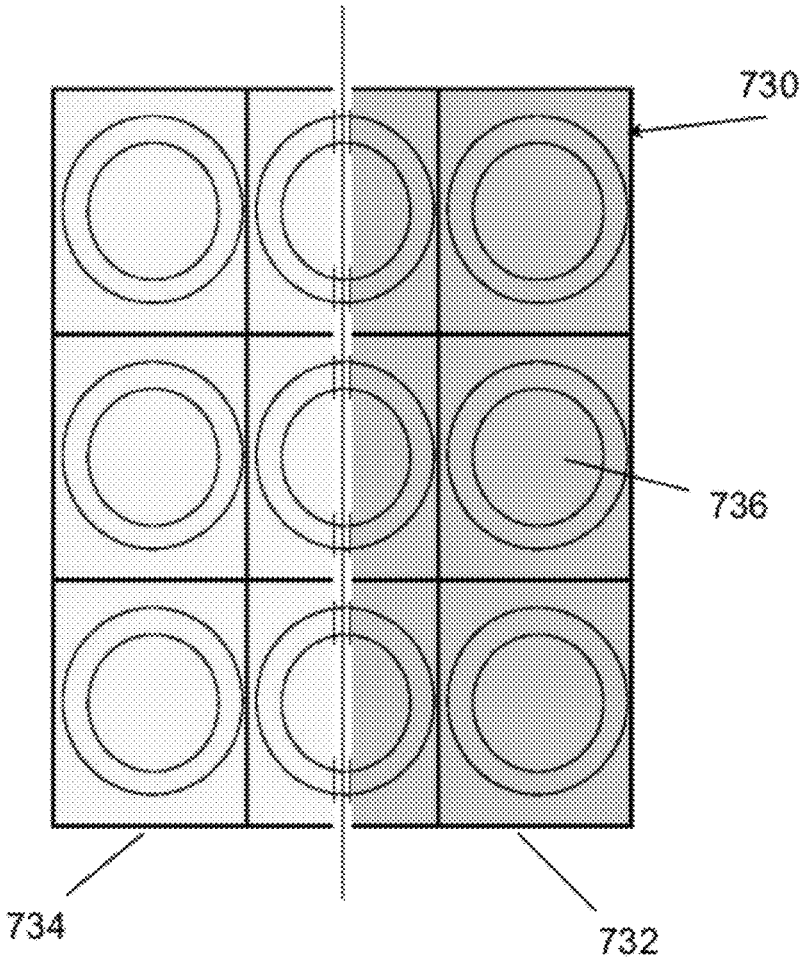
FIGS. 7-8 are top views of various embodiments of a template.

FIG. 7 illustrates an alternative embodiment of a template 730 having nine anchoring ports 736, which can be used with existing installations of wellheads and BOPs. The template 730 can include first and second pieces 732 and 734, which can be combined to collectively form the template 730. Although two pieces are shown, it is contemplated that the template 730 could include two, three, four or more pieces that have equal or differing sizes and dimensions or number of anchoring ports. In this manner, the pieces 732 and 734 could be mated about an existing wellhead and BOP installation. In addition, it is contemplated that a suction cap (not shown) can be installed about the BOP prior to installation of the template 730 to protect the wellhead and facilitate alignment of the template 730, as necessary.

Figure 8:
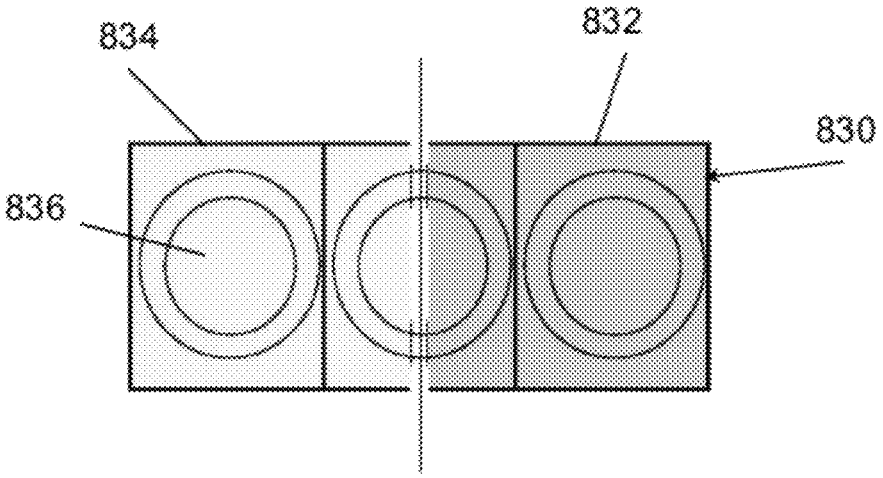

FIG. 8 illustrates another embodiment of a template 830 having three piles 836, which can be used with existing installations of wellheads and BOPs. Similar to the template shown in FIG. 7, the template 830 can include first and second pieces 832 and 834, which can be combined to collectively form the template 830. With respect to the remaining numerals in FIG. 8, the same considerations for like components with like numerals of FIG. 7 apply.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An underwater wellhead closure system, comprising:

a template configured to be secured to a floor of a body of water, comprising a set of anchoring ports;

a suction pile coupled to one of the anchoring ports, and having a cylindrical body having a head portion with a suction pump and an open bottom, wherein the suction pile is configured to provide additional hold down force to the template; and a suction cap coupled to another of the anchoring ports, and having a cylindrical body with an open bottom and a head portion having a second suction pump, wherein the suction cap is sized and dimensioned to encapsulate a blow-out preventer stack having a well-head pipe.

2. The system of claim 1, wherein the template further comprises a second set of anchoring ports that are each removably attached to the template.

3. The system of claim 1, wherein each of the anchoring ports comprises a guide.

4. The system of claim 1, further comprising a ballast ring coupled to at least one of the anchoring ports.

5. The system of claim 1, further comprising a second suction pile coupled to another of the anchoring ports, and wherein the second suction pile is configured to provide additional hold down force to the template.

6. The system of claim 1, wherein the suction cap is secured to the template by a locking device.

7. The system of claim 6, wherein the locking device is a hydraulic locking device.

8. The system of claim 1, wherein the suction cap is sized and dimensioned to encapsulate a blow-out preventer stack.

9. The system of claim 1, wherein the suction cap further comprises a third suction pump.

10. The system of claim 1, wherein the suction cap further comprises first and second ports.

11. The system of claim 1, wherein the suction pile further comprises a ballast ring configured to couple the suction pile to the template.

12. An underwater wellhead closure system, comprising:

a template configured to be secured to a floor of a body of water, comprising a plurality of anchoring ports;

a set of suction piles, each of which is coupled to an anchoring port and has a cylindrical body having a suction pump and an open bottom, wherein each suction pile is configured to provide additional hold down force to the template; and a suction cap coupled to one of anchoring ports, and having a cylindrical body with an open bottom and a head portion having at least one suction pump, wherein the cylindrical body is sized and dimensioned to encapsulate a blow-out preventer stack having a well-head pipe; and wherein the set of suction piles and the suction cap are each configured to engage the floor of the body of water and collectively provide sufficient hold down force to overcome a volume of fluid exiting the well-head pipe and secure the template to the floor of the body of water.

13. The system of claim 12, wherein each of the anchoring ports comprises a guide.

14. The system of claim 1, wherein the floor of the body of water is at least 5,000 feet below a surface of the body of water.

* * * * *